US005201982A

United States Patent [19]

Schmidt

[11] Patent Number: 5,201,982

[45] Date of Patent: Apr. 13, 1993

[54] METHOD FOR PRODUCING SELF-SEALING ENVELOPES

[75] Inventor: Alfons Schmidt, Horhausen, Fed. Rep. of Germany

[73] Assignee: Winkler & Duennebier Maschinenfabrik und Eisengiesserei KG, Neuwied, Fed. Rep. of Germany

[21] Appl. No.: 766,806

[22] Filed: Sep. 26, 1991

[30] Foreign Application Priority Data

Sep. 26, 1990 [DE] Fed. Rep. of Germany ..... 4030414

[51] Int. Cl.[5] ..... B31B 1/26

[52] U.S. Cl. ..... 156/227; 229/80; 271/2; 493/240; 493/245; 493/264; 493/917

[58] Field of Search ..... 156/227, 442.1; 229/68 R, 80; 271/2; 493/244, 245, 240, 243, 264, 917

[56] References Cited

U.S. PATENT DOCUMENTS

| | | | |
|---|---|---|---|
| Re. 19,883 | 3/1936 | Vogel | 229/80 |
| 2,092,149 | 9/1937 | Berkowitz | 229/80 X |
| 2,157,898 | 5/1939 | Hohwart | 229/80 |
| 2,227,679 | 1/1941 | Swift | 229/80 |
| 3,598,024 | 8/1971 | Sauerman | 493/245 X |
| 4,270,909 | 6/1981 | Ireland | 493/245 |

*Primary Examiner*—Michael W. Ball
*Assistant Examiner*—Michele K. Yoder
*Attorney, Agent, or Firm*—W. G. Fasse

[57] ABSTRACT

Self-sealing envelopes having an envelope front with two side flaps and a closure flap, and a bottom flap with an edge strip along the free edge of the bottom flap, are produced by cutting blanks to size, and producing precreases along lines where folds will be made to fold all flaps. A self-sealing adhesive is applied to the inner surface on the closure flap and on the outer surface of the bottom flap edge strip. All precreases are formed on the same side of the blank, whereby the edge strip must be folded in a direction opposite to its precrease. This feature facilitates the movement of the blank through the envelope production machine into which the blank moves with the edge strip leading in the feed advance direction, and all creasing tools operate in the same creasing direction, whereby all precreasing tools can be located on the same side of the blank.

2 Claims, 2 Drawing Sheets

METHOD FOR PRODUCING SELF-SEALING ENVELOPES

FIELD OF THE INVENTION

The invention relates to a method for producing self-sealing envelopes, especially letter mailing envelopes.

BACKGROUND INFORMATION

Envelopes of this type are cut from stock to form foldable blanks, each having an envelope front with two side flaps, with a closure flap, and with a bottom flap with an edge leading a blank in a letter envelope producing machine. The bottom flap is provided with a bottom flap edge strip along its free edge. These blanks are cut to the required size and precrease or score lines are produced along lines to be folded. The components and flaps are then folded and a self-sealing adhesive is applied on the closure flap and on the outside of the edge strip of the bottom flap.

In the conventional production of such self-sealing envelopes it is important that the bottom flap edge strips of finished self-sealing envelopes are folded back sufficiently so that the self-sealing adhesive on the edge strip does not come into contact with the self-sealing adhesive on the closure flap. This requirement makes it necessary that the bottom flap edge strip with its prescore line that will enable the edge strip to be folded back, runs through various, important stations of the letter envelope production machine. Usually the prescore lines are produced by means of a hard prefold knife which works against a counter-roller that has an elastic jacket or which is a rubber roller, whereby those envelope components that adjoin the prescore line are deflected in the folding direction. Under high working speeds and due to this deflection the danger arises that the bottom flap edge-strip, which is deflected due to the prescore line, will collide with components of the letter envelope production machine. Another disadvantage is seen in the disadvantageous arrangement and position of the counter-roller in the letter envelope production machine, especially during the production of the prescore lines. Additionally, the counter-roller is especially inaccessible for making adjustments.

OBJECTS OF THE INVENTION

In view of the foregoing it is the aim of the invention to achieve the following objects singly or in combination:

to provide an envelope folding method that assures a safe and problem free passage of the envelope blank through the production machine at high working speeds; and to prevent the unintended contact between the adhesive carrying closure flap and the bottom flap edge strip.

SUMMARY OF THE INVENTION

According to the invention the present folding method is characterized in that the bottom flap edge strip is first precreased or prescored in a direction opposite to its folded back position before the bottom flap edge strip is folded over into said folded back position, and in that the blank runs through the letter envelope production machine in this form, until, for the purpose of further manufacturing steps, the edge strip is folded against said precrease or prescore direction, into said final folded back position when the envelope is finished.

Thus, according to the invention the bottom flap edge strip has a precrease against its effective finishing folding direction. This feature provides advantages during the operation of the letter envelope production machine and it eliminates conventional measures that heretofore have frequently lead to difficulties and interruptions in the production process. The folding over of the bottom flap edge strip into its finished, folded back position takes place exclusively along the oppositely oriented precrease line.

BRIEF DESCRIPTION OF THE DRAWINGS

The invention will now be described in detail by way of an example embodiment with reference to the accompanying drawings, wherein.

DETAILED DESCRIPTION OF PREFERRED EXAMPLE EMBODIMENTS AND OF THE BEST MODE OF THE INVENTION

Figure 1:
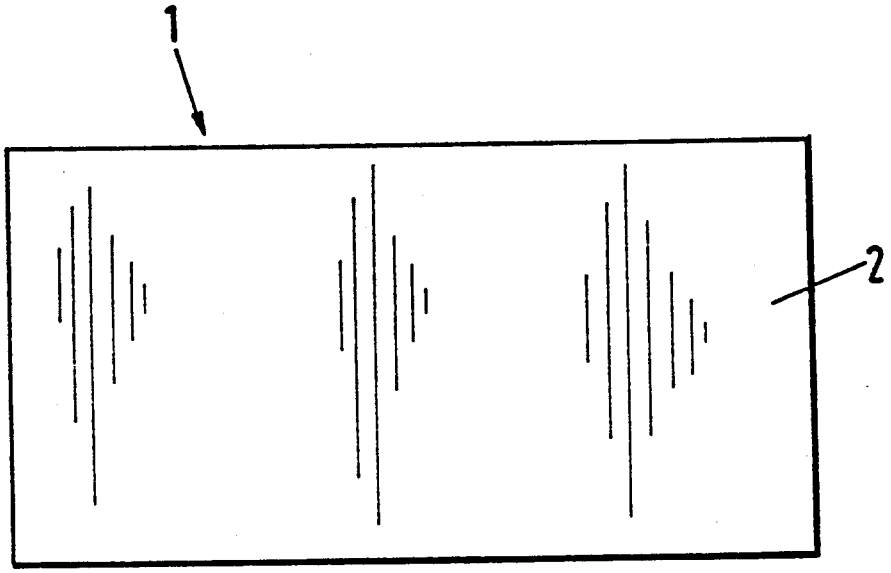
FIG. 1 is a front view of a self-sealing envelope.
Figure 2:
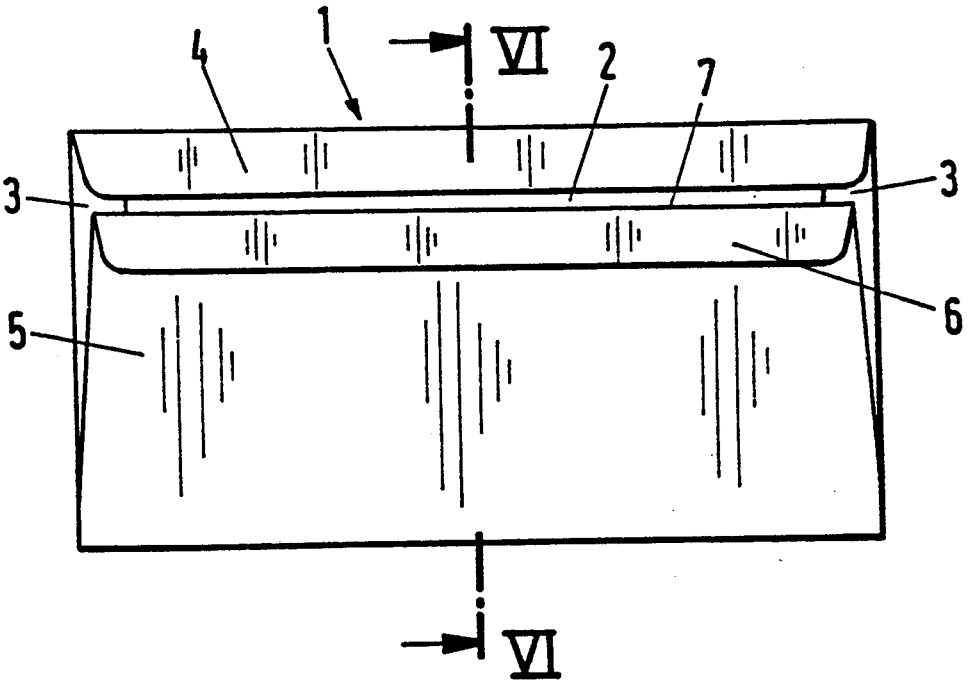
FIG. 2 is a rear view of the envelope of FIG. 1
Figure 3:
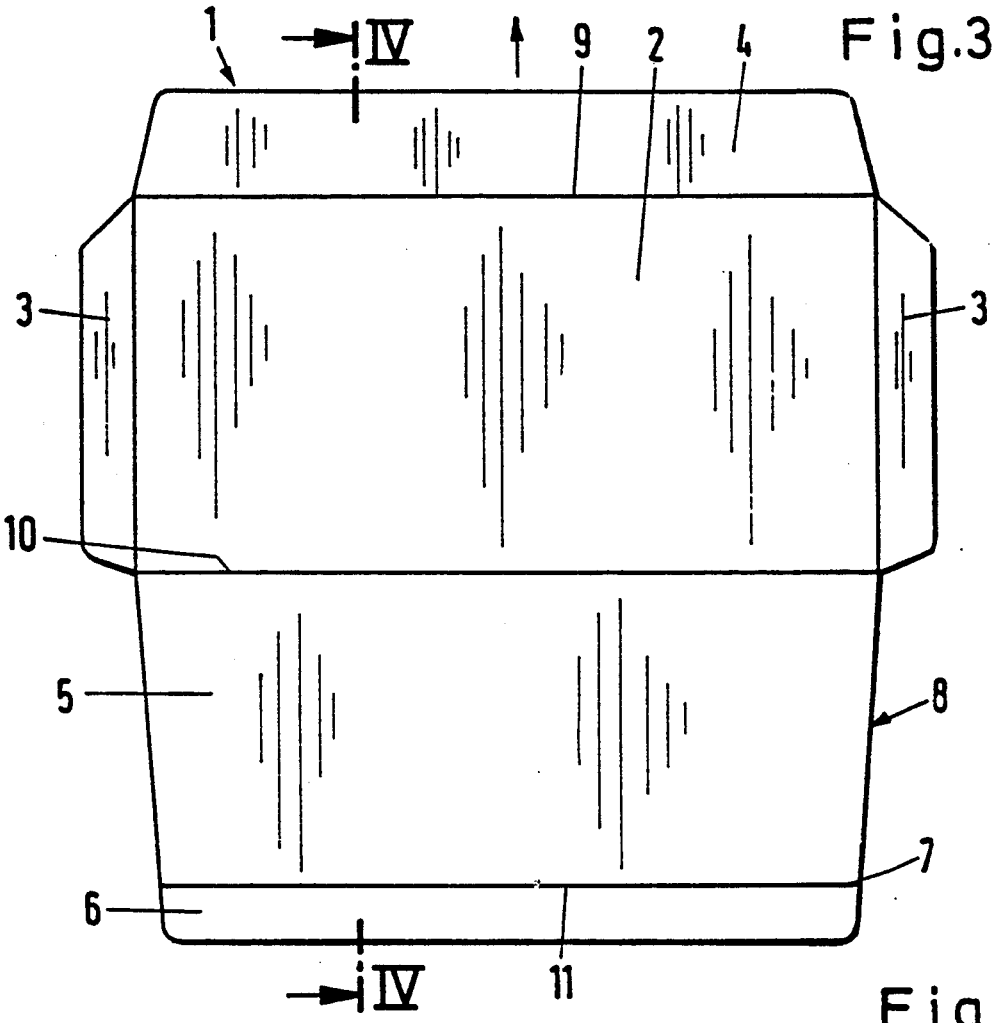
FIG. 3 is an envelope blank still in an unfolded condition.

FIG. 2 shows a folded self-sealing envelope 1 comprising an envelope front 2 with two side flaps 3, a closure flap 4, and a bottom flap 5 with a bottom flap edge strip 6 at its free end 7. FIG. 3 shows an envelope blank 8 also illustrating the elements 1, 2, 3, 4, 5, 6, and 7, but prior to folding.

Figure 4:
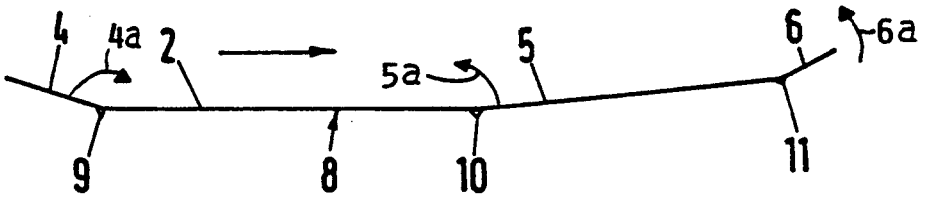
FIG. 4 is a view along section line IV—IV of FIG. 3, showing the prefold of the bottom flap edge strip in a direction opposite to the final folded back position.
Figure 5:
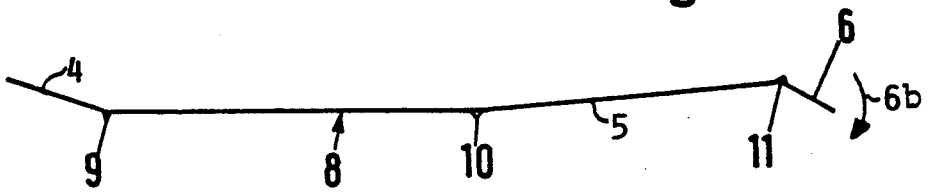
FIG. 5 is a view similar to that of FIG. 4, but showing the bottom flap edge strip in a partly folded back position.

The envelope blank 8 of FIGS. 3 to 5 comprises one precrease 9 between the closure flap 4 and the envelope front 2, a precrease 10 between the envelope front 2 and the back or bottom flap 5, and a precrease 11 between the back or bottom flap 5 and a bottom flap edge strip 6. A precrease in this context is a compression along a crease line in the blank 8, which crease, formed by compression, facilitates the subsequent folding about that crease line. The two precreases 9 and 10 between the envelope front 2 on the one hand and the closure flap 4 and the bottom flap 5 on the other hand, lie in or are effective for folding in the directions 4*a* and 5*a* as shown in FIG. 4 to bring the flap 4 and the flap 5 into the positions the will assume in the finished product. According to the invention, the other precrease 11 is oriented oppositely to the folding in the direction 6*b* performed on the envelope production machine as seen in FIG. 5. More specifically, the precrease 9 is oriented to facilitate the folding of the closure flap 4 in the direction of the arrow 4*a* into the position shown in FIG. 2. Similarly, the precrease 10 is oriented to facilitate the folding of the bottom flap 5 in the direction of the arrow 5*a* into the position shown in FIG. 2. However, according to the invention the precrease 11 is oriented in the direction of the arrow 6*a* which is opposite to the folding direction 6*b* in which the bottom flap edge strip 6 must be folded to assume the finished product position shown in FIG. 2.

The folding of the bottom flap edge strip 6 into the folded back position as shown in FIG. 2, takes place during the production of the self-sealing envelope 1 against the oppositely oriented precrease 11, see FIG. 4. FIG. 5 shows a partial back fold.

It may be undesirable to have a precrease 11 in the final product that is foldable in both directions 6*a* and 6*b*. However, the advantages achieved by such a precrease 11 in the production techniques and in the machine construction by far outweigh any disadvantages because all creasing tools can be arranged on the same side of the envelope blank.

In performing the present method the precrease 11 is produced in the blank envelope 8 basically in the same manner as the other two precreases 9 and 10, namely by respective prefold knives pressing the blank 8 against a rubber roller. The respective machine feature for performing the pressing along a line are known and hence are not described. However, the prefolding tool or all tools work in the same working direction namely on the same side of the envelope blank which leads to a substantial simplification of the letter envelope production machine and jamming of blanks in the machine is avoided.

Figure 6:
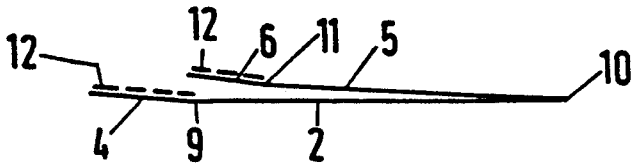
FIG. 6 is a cross-section of a nearly closed self-sealing envelope with an opened closure flap and bottom flap edge strip.

When the folding is completed and the self-sealing envelope 1 has been formed as shown in FIG. 6, a self-sealing adhesive 12 is applied to the closure flap 4 and to the bottom flap edge strip 6 on the strip surface that will face to the outwardly facing surface of the bottom flap 5, as seen in FIG. 2. A coat of self-sealing adhesive 12 is applied to the almost finished self-sealing envelope 1 as shown in (FIG. 6), when the closure flap 4 and the bottom flap edge strip 6 are not yet folded into their finished position according to FIG. 2.

Although the invention has been described with reference to specific example embodiments, it will be appreciated that it is intended to cover all modifications and equivalents within the scope of the appended claims.

What I claim is:

1. A method for producing self-sealing envelopes, comprising the following steps:

(a) providing envelope blanks from flat stock so that each blank has an envelope front with two side flaps, a closure flap, and an envelope bottom flap with an edge strip along a free edge of said envelope bottom flap, (b) producing all precreases on one side of said blank along score lines where folds are to be made, whereby all prefolding tools work in the same working direction, and whereby said score lines bias all flaps and said edge strip toward said one side, (c) first, folding said side flaps along respective score lines in directions toward said one side and applying adhesive to said side flaps, (d) second, folding said bottom flap against said adhesive on said side flaps to form a partly finished envelope in which adhesive receiving surfaces of said closure flap and of said edge strip extend in parallel and next to each other and said edge strip extend in parallel and next to each other and said edge strip is still biased toward said one side by its respective score line, (e) applying self-adhesive to said adhesive receiving surfaces of said closure flap and of said edge strip, and (f) third, folding said closure flap toward said one side in the direction of said bias and folding said edge strip away from said one side in a direction opposite to its bias to form the finished envelope.

2. The method of claim 1, further comprising passing said blank through an envelope production machine so that said edge strip faces in a feed advance direction, whereby said edge strip forms a leading edge travelling in said feed advance direction.

* * * * *

UNITED STATES PATENT AND TRADEMARK OFFICE

CERTIFICATE OF CORRECTION

PATENT NO. : 5,201,982

DATED : April 13, 1993

INVENTOR(S) : Alfons Schmidt

It is certified that error appears in the above-identified patent and that said Letters Patent is hereby corrected as shown below:

Claim 1, column 4, line 25, delete "extend in parallel and next to each other and said";
line 26, delete "edge strip".

Signed and Sealed this
Fifth Day of April, 1994

Bruce Lehman

BRUCE LEHMAN

*Commissioner of Patents and Trademarks*

*Attest:*

*Attesting Officer*